US005233810A

United States Patent [19]

Jennings

[11] Patent Number: 5,233,810

[45] Date of Patent: Aug. 10, 1993

[54] METHOD OF CONSTRUCTING A WALL

[76] Inventor: Stephen R. Jennings, P.O. Box 400041, Euless, Tex. 76040

[21] Appl. No.: 807,136

[22] Filed: Dec. 13, 1991

[51] Int. Cl.[5] ..... E04B 1/16; B32B 31/06

[52] U.S. Cl. ..... 52/745.19; 52/474

[58] Field of Search ..... 52/745, 250, 251, 252, 52/780, 474, 491

[56] References Cited

U.S. PATENT DOCUMENTS

| | | | |
|---|---|---|---|
| 1,345,871 | 7/1920 | Nottebohm | 52/491 |
| 3,768,225 | 10/1973 | Sloan | 52/743 |
| 3,938,294 | 2/1976 | Gaburri | 52/743 |
| 4,865,781 | 9/1989 | Jennings . | |

*Primary Examiner*—Carl D. Friedman
*Assistant Examiner*—M. A. Van Patten
*Attorney, Agent, or Firm*—Charles D. Gunter, Jr.

[57] ABSTRACT

A method of constructing a wall is shown in which vertical structural columns are erected by mounting vertical, precast concrete panels to a vertical structural member located at each column foundation. The distance between two completed structural columns is spanned by sliding a precast, horizontal structural panel within a pair of column vertical recesses. The height of the horizontal panel is less than the total height of the structural columns and the remaining space is filled with a filler material which can assume a variety of shapes and configurations.

12 Claims, 5 Drawing Sheets

METHOD OF CONSTRUCTING A WALL

BACKGROUND OF THE INVENTION

1. Field of the Invention

The present invention relates generally to fence wall construction and, more specifically, to a fence wall constructed by combining precast concrete elements with other materials to produce a strong and aesthetically pleasing structure.

2. Description of the Prior Art

In the past, fences and retaining walls have primarily been constructed by hand. They were constructed one-piece at a time through a combination of mortar and masonry units. The largest single unit of construction was the brick, block or stone itself. The prior art process were consequently slow and labor intensive, requiring masons and skilled workers with a high degree of experience and proficiency. Often the cost of the labor exceeded the cost of the raw materials used in building the fence or wall.

U.S. Pat. No. 4,865,781, issued Sep. 12, 1989, to Stephen R. Jennings, represented an improvement over the existing construction techniques and disclosed a fence wall structure which could be erected at a substantial savings in time and material cost while achieving a permanent, maintenance free and aesthetically pleasing fence or wall. The improvement was achieved by providing a prefabricated concrete fence made up of precast units which were assembled in various combinations. The precast units included both components of the structural columns and the panels used to span the distance between completed columns.

The present invention is directed toward improvements in the method and structure disclosed in the previously referenced U.S. Pat. No. 4,865,781. The present invention provides a fence or wall which can be constructed from prefabricated concrete elements in conjunction with various manufactured building materials. The components of the fence or wall construction are assembled in combinations to give the appearance of brick, stone, molded concrete, or other styles; then combine with contrasting elements of wood, plastic, stone, brick, concrete block, steel or other materials. Using the techniques of the present method, a single semi-skilled worker can assemble the vertical structural columns using as few as two precast panels of varying widths, thicknesses, heights, and styles which are many times larger than the common brick in size. Horizontal precast panels of varying widths, lengths, and styles can be used to span the distance between completed structural columns.

The precast panels which are used for the structural columns and horizontal, spanning panels can be provided with a finish varying from a single side to all sides and edges. These finishes can range from an "as cast form" to an infinite number of patterns and colors. The resulting fence or wall construction is a structure which can utilize a combination of many different materials. These combinations of materials and methods achieve savings of time and cost of material. The resulting structure is a permanent, maintenance free and aesthetically pleasing fence or wall.

SUMMARY OF THE INVENTION

In the method of constructing a wall of the invention, a wall is constructed using precast concrete elements in combination with other building materials. In the method, a plurality of column foundations made of precast or cast-in-place concrete are first installed at various locations, elevations and spacings, as dictated by the requirements of the particular project at hand. A vertical structural member is erected on at least two of the spaced-apart column foundations, each such vertical structural member having a front face, a rear face and opposing side faces. The vertical structural members can be installed when the column foundations are being poured or they can be installed later, as by using mounting brackets and either by welding or bolting the structural members to the column foundations.

A structural column for construction is then formed at each selected column foundation by mounting at least one precast, vertical concrete panel on the respective front and rear faces of each of the vertical structural members and by attaching each precast, vertical concrete panel to the respective front and rear faces. The precast, vertical panels can be connected by any convenient means, such as by welding, bolting or connecting of interlocking brackets. The precast, vertical concrete panels can be made up of a series of small panels with several pairs of lateral edges or as few as two large panels. The vertical structural member creates a column vertical recess between the precast, vertical concrete panels and each of the opposing side faces of the vertical structural members. The width of the recess is determined by the width of the structural member utilized. The thickness and external configuration of the precast, vertical concrete panels can also vary, depending upon the intended application.

After the structural columns are completed, at least one precast horizontal structural panel is installed to span the distance between the vertical recesses created between two adjacent columns. Each of the precast horizontal panels has lateral edges and vertical edges, the vertical edges being adapted to matingly engage the respective column vertical recesses.

Alternatively, the precast horizontal panels can be installed first and braced between the two selected vertical structural members. The vertical, precast concrete panels can then be installed to complete the structural columns. Most preferably, the structural columns are completed first and the precast horizontal panels are lifted to a height that will clear the tops of the structural columns and are then lowered into the column vertical recesses created by the vertical structural members. The panels are lowered until both ends thereof are firmly resting on the column foundations. They may be leveled by inserting spacers or shims under each end thereof.

Preferably, the length of the opposing vertical edges of the horizontal, precast panels define a vertical height of the panel which is less than the height of the adjacent structural columns. At least a portion of the remaining vertical height between the panel top lateral edge and the height of the adjacent columns and spanning the distance between adjacent columns is filled with a filler material. These materials can include brick, block, stone, precast panels, wood, plastic, steel and the like. The filler materials can be installed singularly or in combination of any two, three or more. The filler material provides an aesthetically pleasing contrast in color and texture.

The patterns, design and size of the horizontal precast panels can vary from one set of structural columns to the next. The tops of the structural columns can also be treated with a variety of treatments including cast-in-place concrete, precast concrete units, cast stone units, brick, stone, metals, plastic or wood. Similar treatments can be provided for the top lateral edges of the horizontal precast panels.

Additional objects, features and advantages will be apparent in the written description which follows.

BRIEF DESCRIPTION OF THE DRAWINGS

The novel features believed characteristic of the invention are set forth in the appended claims. The invention itself; however, as well as the preferred mode of use, further objects and advantages thereof, will best be understood by reference to the following detailed description of an illustrative embodiment when read in conjunction with the accompanying drawings, wherein:

DETAILED DESCRIPTION OF THE INVENTION

The method of the invention is applicable to all types of ornamental and utilitarian walls and fences including retaining walls, privacy walls, sound barrier walls, and fences, and the like. The term "wall" and "fence" are therefore used interchangeably in the discussion which follows. The wall is first located with reference to building property or lines set out to determine the location of the wall. Using conventional practice, points are located for the foundations of the vertical, structural columns. The column locations are separated by predetermined distances according to, e.g., the property lines, length of the wall, etc. The earth is then excavated to comply with engineering specifications for the vertical structural columns in accordance with local building codes and manufacturer's requirements. The column foundations can be either round, square, polygonal, or piers. The elevation of each foundation is determined and noted and reinforcement is placed in the excavation and stabilized. The reinforcement reaches from the approximate bottom of the excavation to within a few inches of what will become the top surface of the column foundation, or can extend to the height of the column. A completed column foundation is indicated at 11 in FIG. 1.

Figure 1:
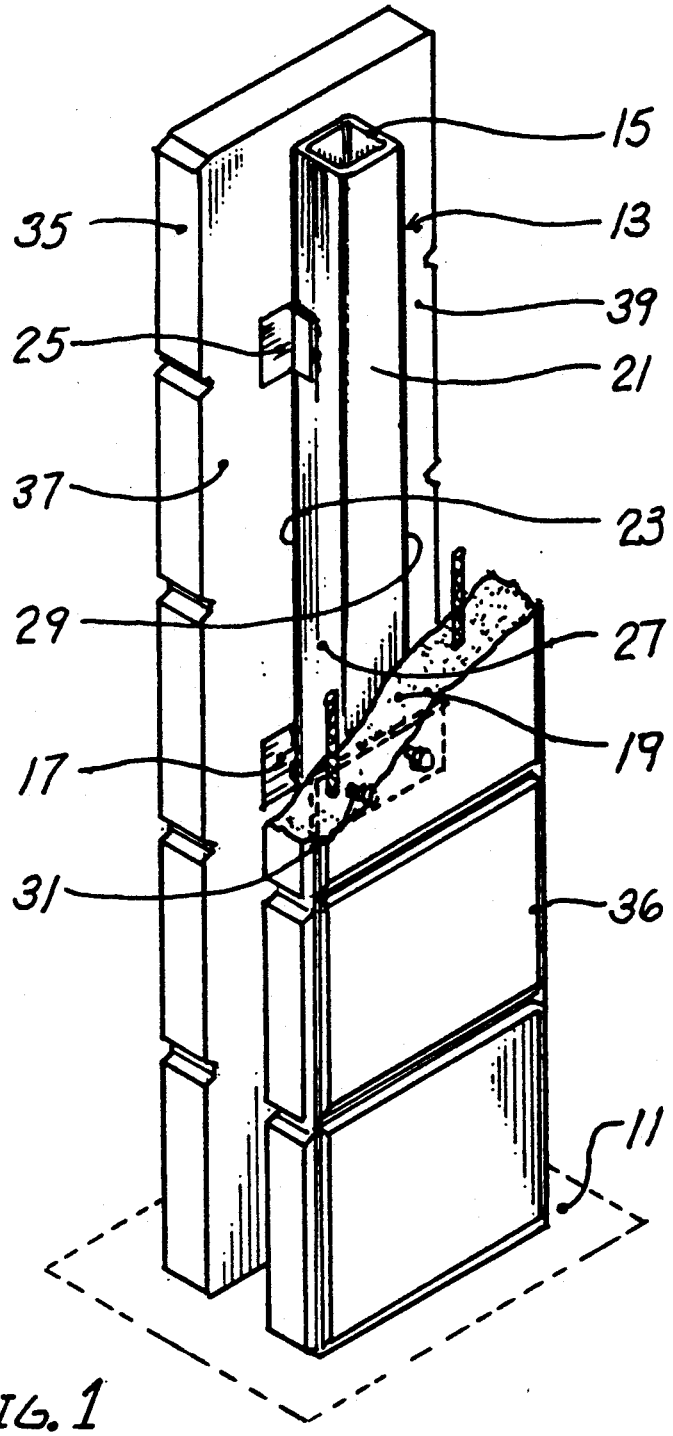
FIG. 1 is an isolated view of an structural column used in the method of the invention, the column being partly broken-away to better illustrate the vertical structural member thereof.

Each column foundation has an associated vertical structural member 13. In the embodiment of FIG. 1, the vertical structural member 13 is a length of square, tubular shape or combination of shapes to create a box shape of steel having a hollow interior 15. The member 13 is placed in the excavated foundation location in the approximate center thereof or as close to center as possible, still remaining within the line of the other portions of the wall or fence to be constructed. Concrete can then be poured into the excavation and brought to the level of the desired top surface of the pier or column foundation. The structural member 13 is brought to plumb, in all directions, while the concrete is in the plastic state.

It will be understood that although the previously described method steps are preferred, that the vertical structural member 13 can be installed after the completion of pouring of the column foundation 11, as by welding on attachment brackets and bolting the attachment brackets to the poured foundation 11.

As shown in FIG. 1, the vertical structural member 13 preferably has associated therewith mounting brackets 17, 19 which are welded to the front and rear faces 21, 23 of the member 13, respectively. The mounting brackets can assume various configurations and can include side flanges, e.g., flange 25 which engage the opposing side faces 27, 29 of the structural member 13.

In the next step of the method, a structural column is formed at the selected column foundations (see for example, structural columns 31, 33 in FIG. 2) by mounting at least one precast, vertical concrete panel (35 in FIG. 1) on the respective front and rear faces 21, 23 of each of the vertical structural members 13 and attaching each precast, vertical concrete panel 35 to the respective front and rear faces. This can be accomplished, as by utilizing bolts 37 and engaging the bolts with the mounting brackets 17, 19. In this way, a column vertical recess 37, 39 is formed between the precast, vertical concrete panels (35, 36 in FIG. 2) and each of the opposing side faces 27, 29 of the vertical structural member 13.

Although the vertical, precast concrete panels 35 can comprise two or more precast concrete blocks of square or rectangular shape, stacked upon one another and having open interiors to receive re-bar rods and the like, the precast, vertical concrete panels are preferably provided as unitary plates. A typical plate or panel, such as panel 35, will be, as an example, 18 inches wide, 3 ½ inches thick and, for example, 75 inches in height. The sizes and shapes of the vertical, precast concrete panels can vary to meet the requirements of the particular project. The plates can be precast in forms in the controlled environment of a manufacturing plant or molded in a variety of plain or decorative appearances, such as brick, stone, wood, rock, fractured fins and other patterns and be provided in an infinite number of variations.

Figure 3:
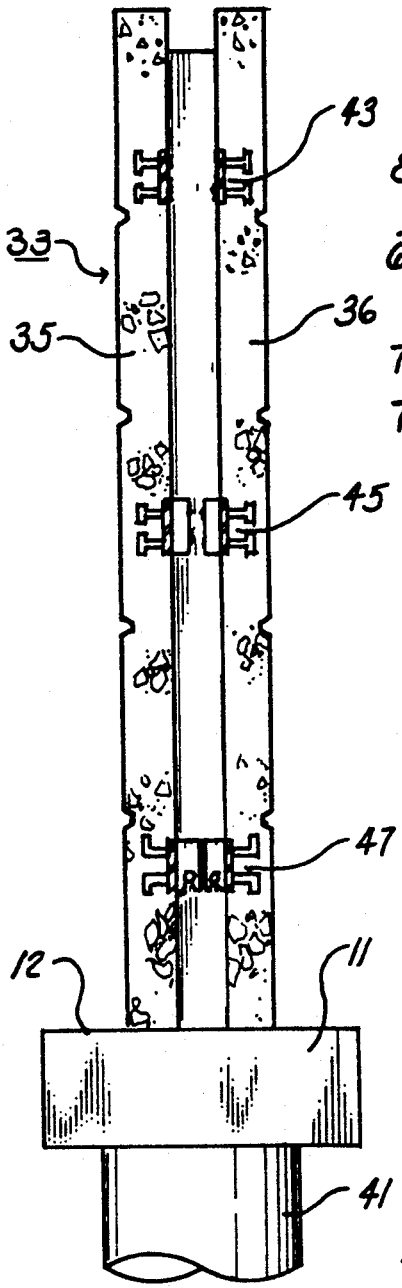
FIG. 3 is a partial, cross-sectional view of the structural column of FIG. 1 showing the column foundation and the mounting brackets used to install the vertical structural member.

FIG. 3 is a side, cross-sectional view of the structural column 33 showing the column foundation 11 including pier 41 and top surface 12 and showing various types of mounting brackets 43, 45, 47 used to erect the precast, vertical concrete panels 35, 36.

Figure 5:
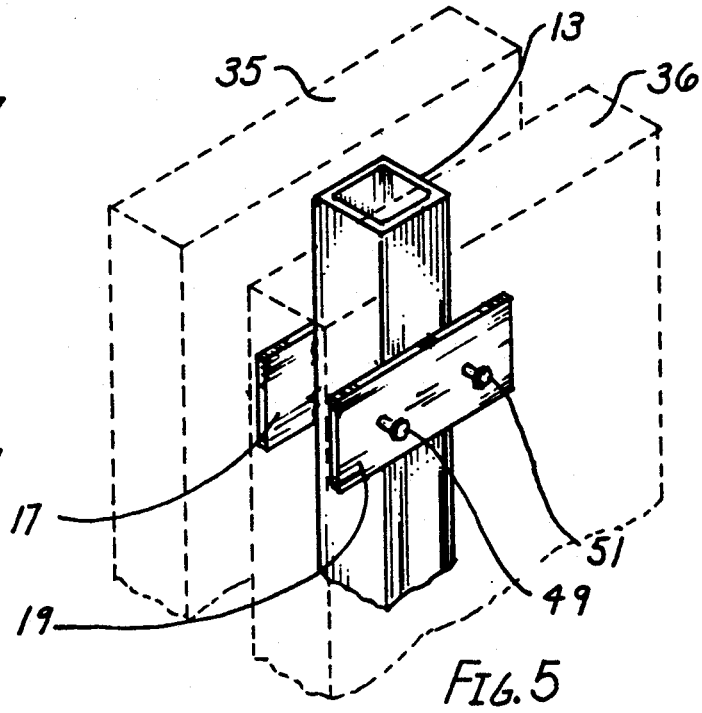
FIG. 5 is a partial, isolated view of the mounting brackets used in erecting the vertical, precast concrete panels of the structural column of FIG. 1.

FIG. 5 is a close-up, isolated view of a vertical structural member 13 with associated mounting brackets 17, 19 each of which carries mounting bolts 49, 51 used to erect the vertical, precast, concrete panels 35, 36. This can also be accomplished by imbedded weld plates in the back of the vertical panels, which are simply welded onto the vertical structural member 13.

Preferably, the distance between at least two of the adjacent structural columns (e.g., columns 33, 51 in FIG. 2) is spanned by at least one horizontal, precast panel 53. Preferably, the horizontal panel 53 is installed by sliding the horizontal panel within the vertical column recesses (39, 55 in FIG. 2) created by the two adjacent columns 33, 51. The panel 53 has top and bottom lateral edges 57, 59 and opposing vertical edges 61, 63 which are received within the respective vertical column recesses 39, 55.

Figure 2:
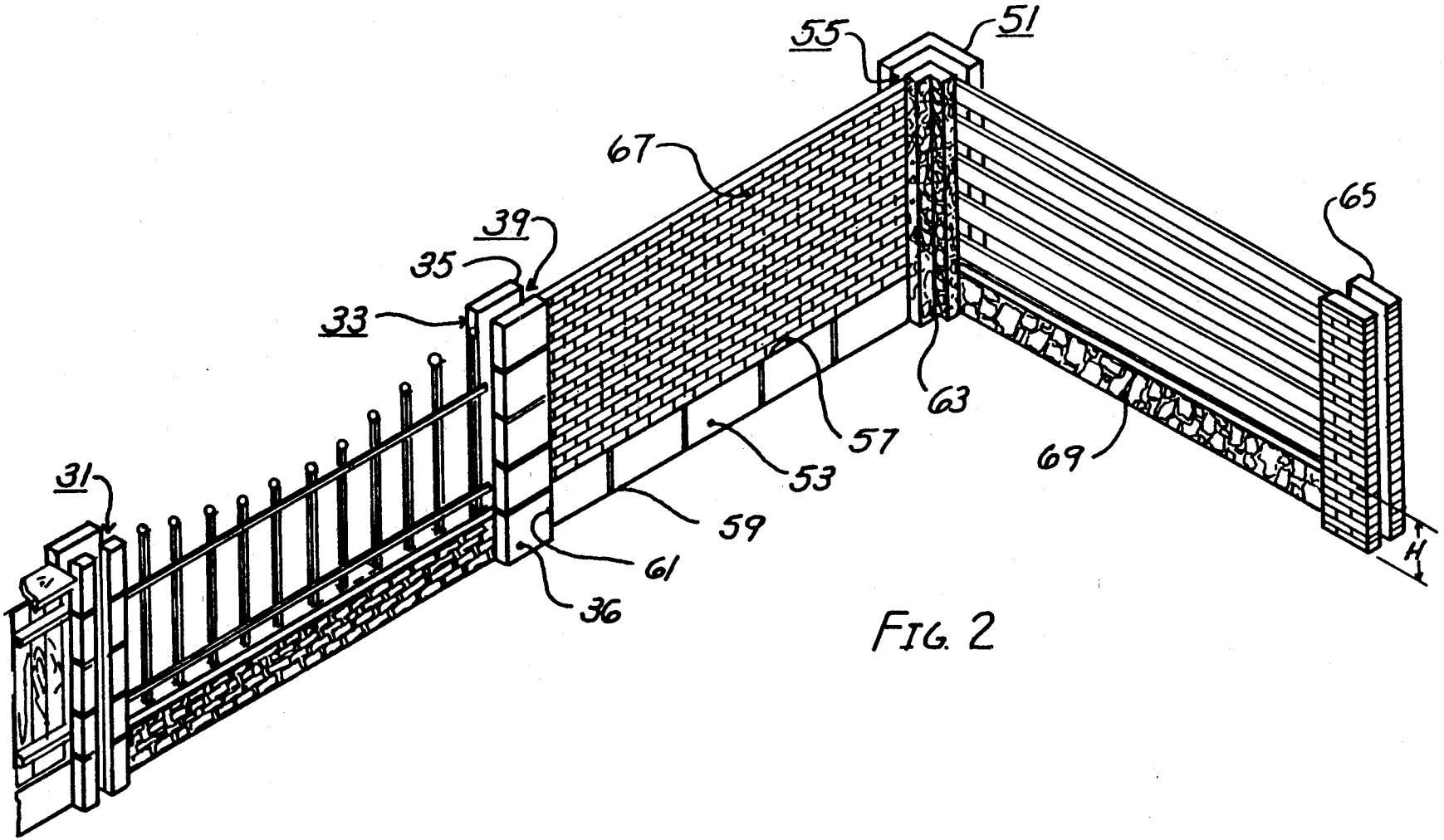
FIG. 2 is a partial, perspective view of the face wall constructed utilizing the method of the invention showing a variety of filler materials used with various precast concrete elements.

The horizontal, precast panel 53 is preferably lifted so as to clear the tops of the structural columns 33, 51 and is lowered through the column recesses to the position shown in FIG. 2. In this position, the horizontal panel 53 rests on the top surfaces (12 in FIG. 3) of the column foundations 11. If the panel requires leveling, it can be leveled through the use of mortar, concrete, plastic, steel or appropriate shims. The leveling material would be placed between the bottom lateral edge of the panel 53 and the top of the column foundation. Wedge shaped spacers can also be used to locate the horizontal, precast panels within the vertical, column recesses.

The length of the opposing vertical edges 61, 63 of the horizontal, precast panel 53 defines a vertical height ("h" in FIG. 2) which is preferably less than the total height of the adjacent structural column 65. The remaining height above each horizontal panel 53 is preferably filled with a filler material. This filler material can be brick, stone, wood, steel, wrought-iron, screening materials, concrete, etc. There are also an infinite number of panel treatments which can be used to fill the space occupied by the filler material 67. The wall can then be completed by finishing the top of the wall with a suitable treatment ranging from a single row of brick to an elaborate cast stone piece. The column tops can also be finished in similar fashion.

It will also be understood that the horizontal, precast panel 53 can be installed by first erecting a pair of vertical structural members 13 on at least two of the spaced-apart column foundations 11 and thereafter spanning the distance between th respective side faces (e.g. face 29 in FIG. 1) of two adjacent vertical structural members by bracing the horizontal panel therebetween. The structural column would then be completed by mounting precast, vertical concrete panels (35 and 36 in FIG. 1) on the respective front and rear faces of each of the vertical structural members. The remaining steps in the construction technique would be identical to those previously described.

Figure 4:
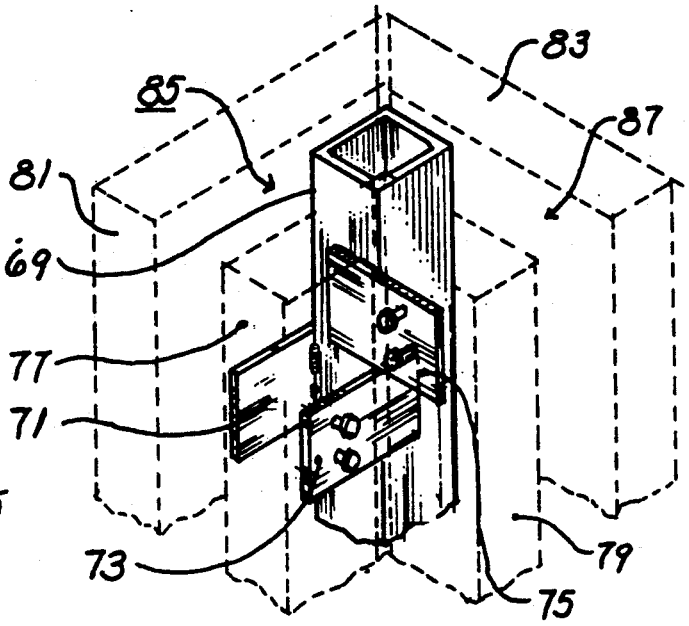
FIG. 4 is a partial, isolated view of a corner column of the type used in the fence of FIG. 2.

The construction method o the invention is exceedingly versatile, and is well adapted for use in a variety of specific job applications. For example, FIG. 4 shows a corner construction of the wall of FIG. 2 in close-up, isolated fashion. Mounting brackets 71, 73, 75 are used to mount the vertical, precast concrete panels 77, 79, 81, 83, thereby provided vertical column recesses 85, 87 for receiving horizontal, precast panels (e.g., 53, 89 in FIG. 2).

Figure 6:
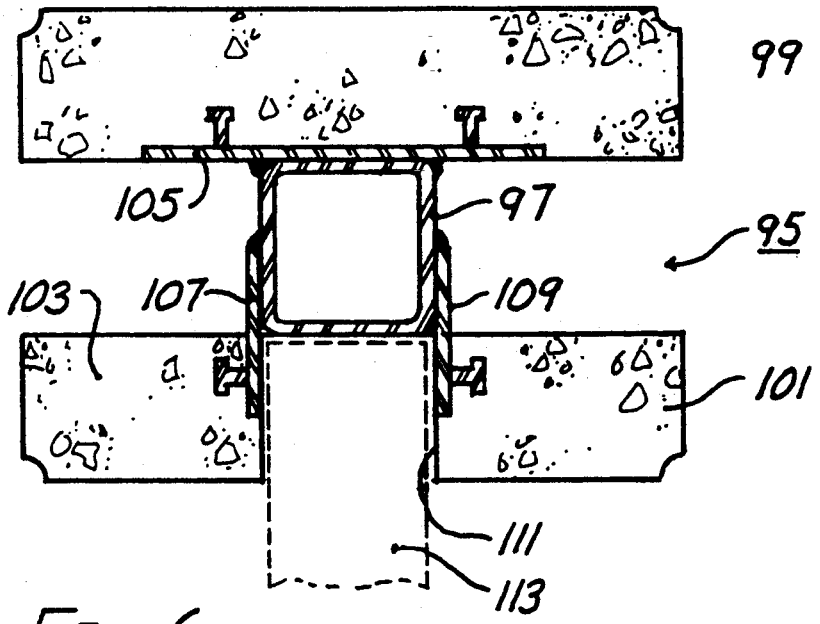
FIG. 6 is a top view of another form of the structural column constructed according to the method of the invention, the column being adapted to support an intermediate precast, horizontal panel.

FIG. 6 shows a structural column 95 having a vertical structural member 97 joined to vertical precast concrete panels 99, 101, 103 by mounting brackets 105, 107, 109. In this manner, a vertical recess 111 is created for receiving an intermediate horizontal, precast panel (shown in dotted lines as 113 in FIG. 6) which might serve as an intermediate connecting wall in the completed wall system.

Figure 7:
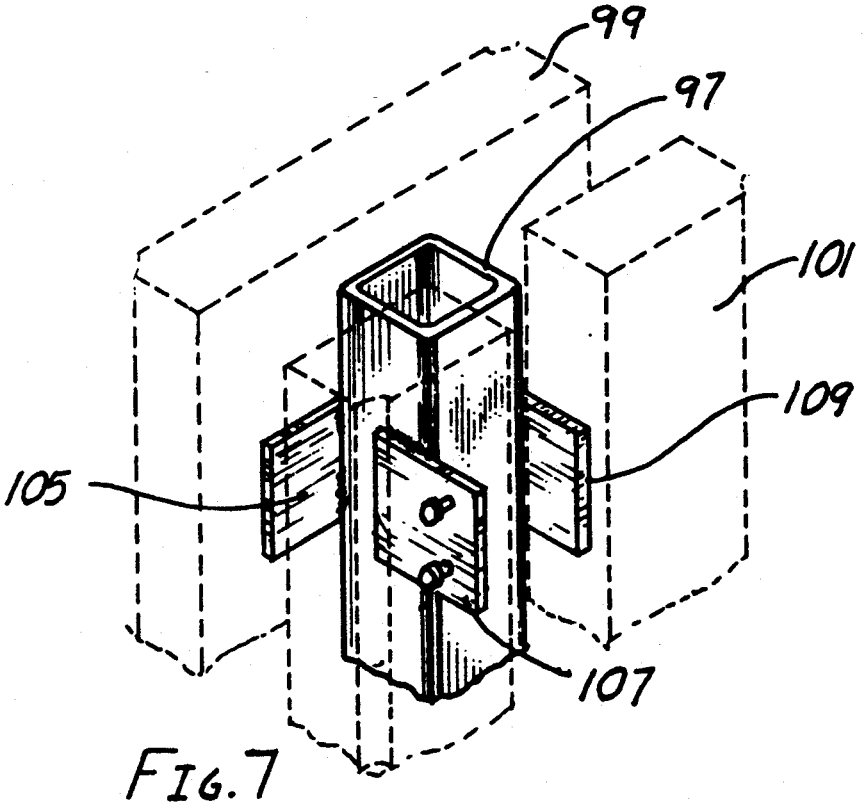
FIG. 7 is a partial, isolated view of the structural column of FIG. 6 showing the mounting brackets used to mount the vertical structural member to the vertical, precast concrete panels.

FIG. 7 is a partial, isolated view of the mounting brackets 105, 107, 109 and vertical structural member 97 used in forming the structural column of FIG. 6.

Figure 8:
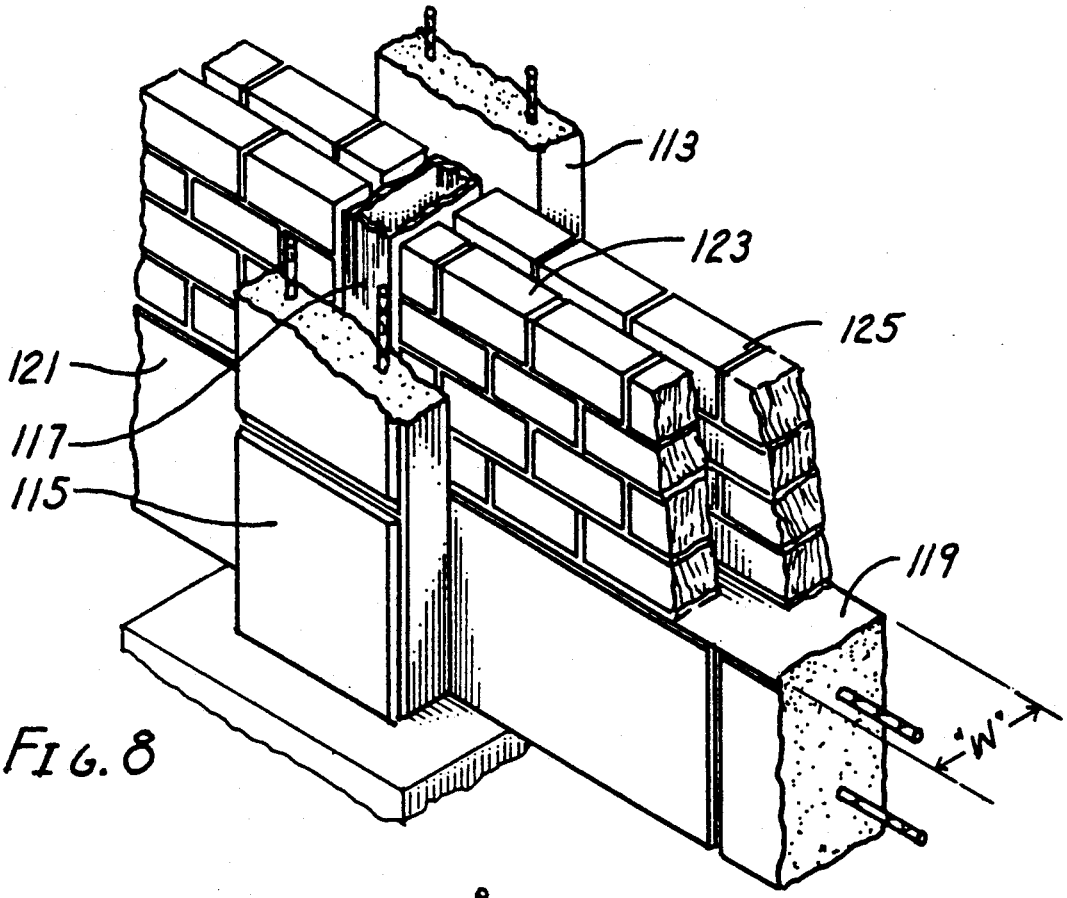
FIG. 8 is a partial, perspective view of a fence wall constructed according to the method of the invention showing a horizontal, precast concrete panel of increased width and double walls of filler material.

FIG. 8 is an isolated view of a portion of a completed fence wall, constructed according to the method of the invention. In the embodiment of FIG. 8, the vertical, precast concrete panels 113, 115 are joined by a vertical structural member 117 of greater width than the member 13 in FIG. 1. The horizontal, precast panels 119, 121 are also of greater relative width ("w" in FIG. 8), allowing the panels 119, 121 to support double walls 123, 125 of brick filler material laid to fill the remaining vertical space to the approximate vertical height of the adjacent structural columns.

Figure 9:
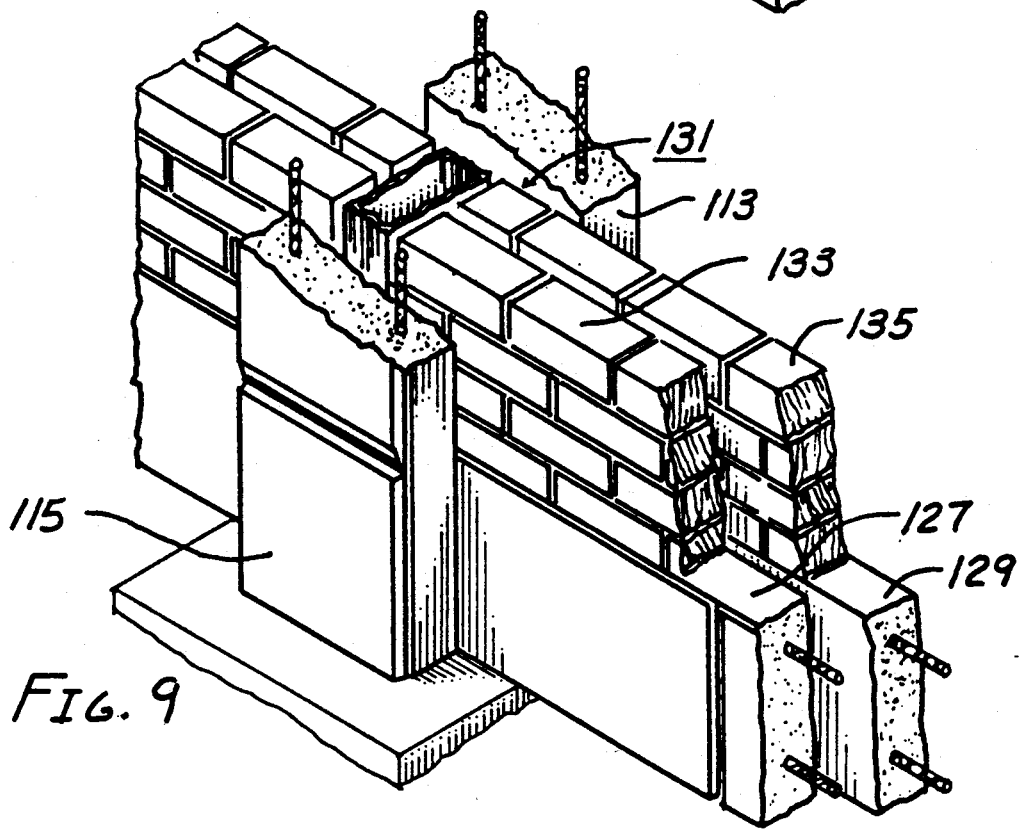
FIG. 9 is a view similar to FIG. 8 but showing a pair of precast, horizontal panels installed between the vertical recesses of two adjacent structural columns and supporting double walls of filler material.

FIG. 9 is a view similar to FIG. 8 but with a pair of horizontal precast panels 127, 129 installed between the vertical, precast concrete panels 113, 115 in the vertical column recess 131. The pair of panels 127, 129 support double walls 133, 135 of brick filler material.

An invention has been provided with several advantages. A single, semi-skilled worker can assemble the structural columns of the invention utilizing two vertical, precast concrete panels and an internal, vertical structural member. The intermediate wall or horizontal panels can be easily installed with a small tractor or mechanical lift. The horizontal panels can be removed and replaced if damaged. By using precast units, a fence or wall can be quickly and easily erected with a minimum labor expense using semi-skilled workers under varying weather conditions.

While the invention has been shown in only one of its forms, it is not thus limited but is susceptible to various changes and modifications without departing from the spirit thereof.

What is claimed is:

1. A method of constructing a wall utilizing precast concrete elements, comprising the steps of:

installing a plurality of column foundations at selected, spaced-apart locations;

erecting a permanent vertical structural member on approximately the center of at least two of the spaced-apart column foundations, each vertical structural member having a front face, a rear face and opposing side faces;

forming a structural column at each selected column foundation by mounting at least one vertical, precast concrete panel on the respective front and rear faces of each of the vertical structural members and attaching each vertical, precast concrete panel to the respective front and rear faces, whereby a column vertical recess is formed between the vertical, precast concrete panels and each of the opposing side faces of the vertical structural members; and spanning the distance between the two structural columns with a spanning material.

2. A method of constructing a wall utilizing precast concrete elements, comprising the steps of:

installing a plurality of column foundations at selected, spaced-apart locations;

erecting a permanent vertical structural member on approximately the center of at least two of the spaced-apart column foundations, each vertical structural member having a front face, a rear face and opposing side faces;

forming a structural column at each selected column foundation by mounting at least one vertical, precast concrete panel on the respective front and rear faces of each of the vertical structural members and attaching each vertical, precast concrete panel to the respective front and rear faces, whereby a column vertical recess is formed between the vertical, precast concrete panels and each of the opposing side faces of the vertical structural members; and spanning the distance between the two structural columns by sliding a structural panel within the vertical recesses of two adjacent columns, the panel having lateral edges and vertical edges, the vertical edges being adapted to matingly engage the respective column vertical recesses.

3. A method of constructing a wall utilizing precast concrete elements, comprising the steps of:

installing a plurality of column foundations at selected, spaced-apart locations;

erecting a permanent vertical structural member on approximately the center of at least two of the spaced-apart column foundations, each vertical structural member having a front face, a rear face and opposing side faces;

forming a structural column at each selected column foundation by mounting at least one precast concrete panel on the respective front and rear faces of each of the vertical structural members and attaching each precast concrete panel to the respective front and rear faces, whereby a column vertical recess is formed between the vertical, precast concrete panels and each of the opposing side faces of the vertical structural members;

spanning the distance between the two structural columns by sliding a horizontal structural panel within the vertical recesses of two adjacent columns, the panel having top and bottom lateral edges and opposing vertical edges, the opposing vertical edges being adapted to matingly engage the respective column vertical recesses, the length of the opposing vertical edges defining a vertical height of the horizontal panel, the vertical height being less than the height of the adjacent structural columns; and wherein at least a portion of the remaining vertical height between the horizontal panel top lateral edge and the height of the adjacent columns is filled with a filler material.

4. The method of claim 3, wherein the filler material is comprised of a series of discrete modules.

5. The method of claim 3, wherein the filler material is at least one additional precast panel.

6. The method of claim 3, wherein the filler material is a brick lattice formed by laying individual bricks with mortar to form a preselected pattern.

7. A method of constructing a wall utilizing precast concrete elements, comprising the steps of:

installing a plurality of column foundations at selected, spaced-apart locations;

erecting a permanent vertical structural member on approximately the center of at least two of the spaced-apart column foundations, each vertical structural member having a front face, a rear face and the opposing side faces;

spanning the distance between the respective side faces of two adjacent vertical structural members by bracing at least one horizontal panel between the side faces, the horizontal panel having top and bottom lateral edges and opposing vertical edges, the vertical edges being aligned generally parallel to the opposing side faces of the two adjacent vertical structural members; and forming a structural column at each selected column foundation by mounting at least one vertical, precast concrete panel on the respective front and rear faces of each of the vertical structural members and attaching each vertical, precast concrete panel to the respective front and rear faces, whereby a column vertical recess is formed between each of the vertical, precast concrete panels and the opposing side faces of the vertical structural members, the vertical edges of the horizontal panel being received within the respective column vertical recesses so formed.

8. The method of claim 7, wherein the length of the opposing vertical edges of the horizontal panel defines a vertical height of the horizontal panel, the vertical height being less than the height of the adjacent structural columns; and wherein at least a portion of the remaining vertical height between the top lateral edge of the horizontal panel and the height of the adjacent columns is filled with a filler material.

9. The method of claim 8, wherein the filler material is comprised of a series of discrete modules.

10. The method of claim 8, wherein the filler material is at least one additional precast panel.

11. The method of claim 8, wherein the filler material is a brick lattice formed by laying individual bricks with mortar to form a preselected pattern.

12. A method of constructing a wall utilizing precast concrete elements, comprising the steps of:

installing a plurality of column foundations at selected, spaced-apart locations;

erecting a permanent vertical structural member having a given height on approximately the center of at least two of the spaced-apart column foundations, each vertical structural member having a front face, a rear face and opposing side faces;

forming a structural column at each selected column foundation by mounting one vertical, precast concrete panel, of substantially the entire height of the vertical structural member on the respective front and rear faces of each of the vertical structural members and attaching the vertical, precast concrete panel to the respective front and rear faces, in order to form two column vertical recesses between the vertical, precast concrete panels and each of the opposing side faces of the vertical structural members; and spanning the distance between the two structural columns with a spanning material.

* * * * *